US011019423B2

(12) United States Patent
Hou

(10) Patent No.: US 11,019,423 B2
(45) Date of Patent: May 25, 2021

(54) ACTIVE NOISE CANCELLATION (ANC) HEADPHONE AND ANC METHOD THEREOF

(71) Applicant: GEAR RADIO ELECTRONICS CORP., Hsinchu County (TW)

(72) Inventor: Wen-Sheng Hou, Miaoli County (TW)

(73) Assignee: GEAR RADIO ELECTRONICS CORP.

( * ) Notice: Subject to any disclaimer, the term of this patent is extended or adjusted under 35 U.S.C. 154(b) by 0 days.

(21) Appl. No.: 16/429,429

(22) Filed: Jun. 3, 2019

(65) Prior Publication Data

US 2020/0329298 A1 Oct. 15, 2020

Related U.S. Application Data

(60) Provisional application No. 62/833,013, filed on Apr. 12, 2019.

(51) Int. Cl.

| | |
|---|---|
| ***H04R 1/10*** | (2006.01) |
| ***G10K 11/178*** | (2006.01) |
| ***H04R 1/08*** | (2006.01) |

(52) U.S. Cl.
CPC ..... *H04R 1/1083* (2013.01); *G10K 11/178* (2013.01); *H04R 1/083* (2013.01); *G10K 2210/108* (2013.01)

(58) Field of Classification Search
None
See application file for complete search history.

(56) References Cited

U.S. PATENT DOCUMENTS

| | | | | |
|---|---|---|---|---|
| 5,452,361 A * | 9/1995 | Jones | G10K 11/178 381/71.6 |
| 2014/0044275 A1* | 2/2014 | Goldstein | H04R 1/1083 381/71.6 |
| 2014/0126733 A1* | 5/2014 | Gauger, Jr. | G10K 11/178 381/71.6 |

* cited by examiner

*Primary Examiner* — Antim G Shah
(74) *Attorney, Agent, or Firm* — Innovation Counsel LLP

(57) ABSTRACT

Provided is an active noise cancellation (ANC) method applied for an ANC headphone. The ANC method includes: in a channel estimation mode, estimating a plurality of environment channels by generating, transmitting and capturing a training signal; in the channel estimation mode, tuning a plurality of ANC filters based on the estimated plurality of environment channels; and in a normal mode, performing ANC on an input signal based on the plurality of ANC filters.

6 Claims, 8 Drawing Sheets

ACTIVE NOISE CANCELLATION (ANC) HEADPHONE AND ANC METHOD THEREOF

CROSS-REFERENCE TO RELATED ART

This application claims the benefit of US provisional application Ser. No. 62/833,013, filed Apr. 12, 2019, the disclosure of which is incorporated by reference herein in its entirety.

TECHNICAL FIELD

The disclosure relates in general to an active noise cancellation (ANC) headphone and an ANC method thereof.

BACKGROUND

Active noise cancellation (ANC) technology has been developing for many years with a range of headphones incorporating ANC technology (also known as ambient noise reduction and acoustic noise cancelling headphones). Noise-cancelling headphones, or noise-canceling headphones, are headphones that reduce unwanted ambient sounds using active noise control. This is distinct from passive headphones which, if they reduce ambient sounds at all, use techniques such as soundproofing. Typically, headphone manufactures do extensive research and perform various factory tests and tuning for the ANC headphones. However, due to the variability in the physical characteristics from one headphone to another, the physical characteristics of the user's ear, and how users wear the headphones, each headphone may perform differently from user to user and may not provide optimum performance for each user.

Noise cancellation makes it possible to listen to audio content without raising the volume excessively. It can also help a passenger sleep in a noisy vehicle such as an airliner. Noise-cancelling headphones can improve listening enough to completely offset the effect of a distracting concurrent activity.

Thus, it is with respect to these and other considerations that the invention has been made.

SUMMARY

According to one embodiment, provided is an active noise cancellation (ANC) method applied for an ANC headphone. The ANC method includes: in a channel estimation mode, estimating a plurality of environment channels by generating, transmitting and capturing a training signal; in the channel estimation mode, tuning a plurality of ANC filters based on the estimated plurality of environment channels; and in a normal mode, performing ANC on an input signal based on the plurality of ANC filters.

According to another embodiment, provided is an active noise cancellation (ANC) headphone including: a training signal generator for generating a training signal; a channel estimator and ANC filter tuner; first and second speaker coupled to the training signal generator; first and second microphone coupled to the channel estimator and ANC filter tuner; a plurality of ANC filters coupled to the second speaker; and an isolator, for isolating the first speaker from the first microphone. In a channel estimation mode, the training signal generator generates the training signal to the first and the second speakers, the first and the second microphone captures sounds from the first speaker or from the second speaker, and the channel estimator and ANC filter tuner estimates a plurality of environment channels based on outputs from the first and the second microphones. In the channel estimation mode, the plurality of ANC filters are tuned by the channel estimator and ANC filter tuner based on the estimated plurality of environment channels. In a normal mode, ANC is performed on an input signal based on the plurality of ANC filters.

Figure 1:
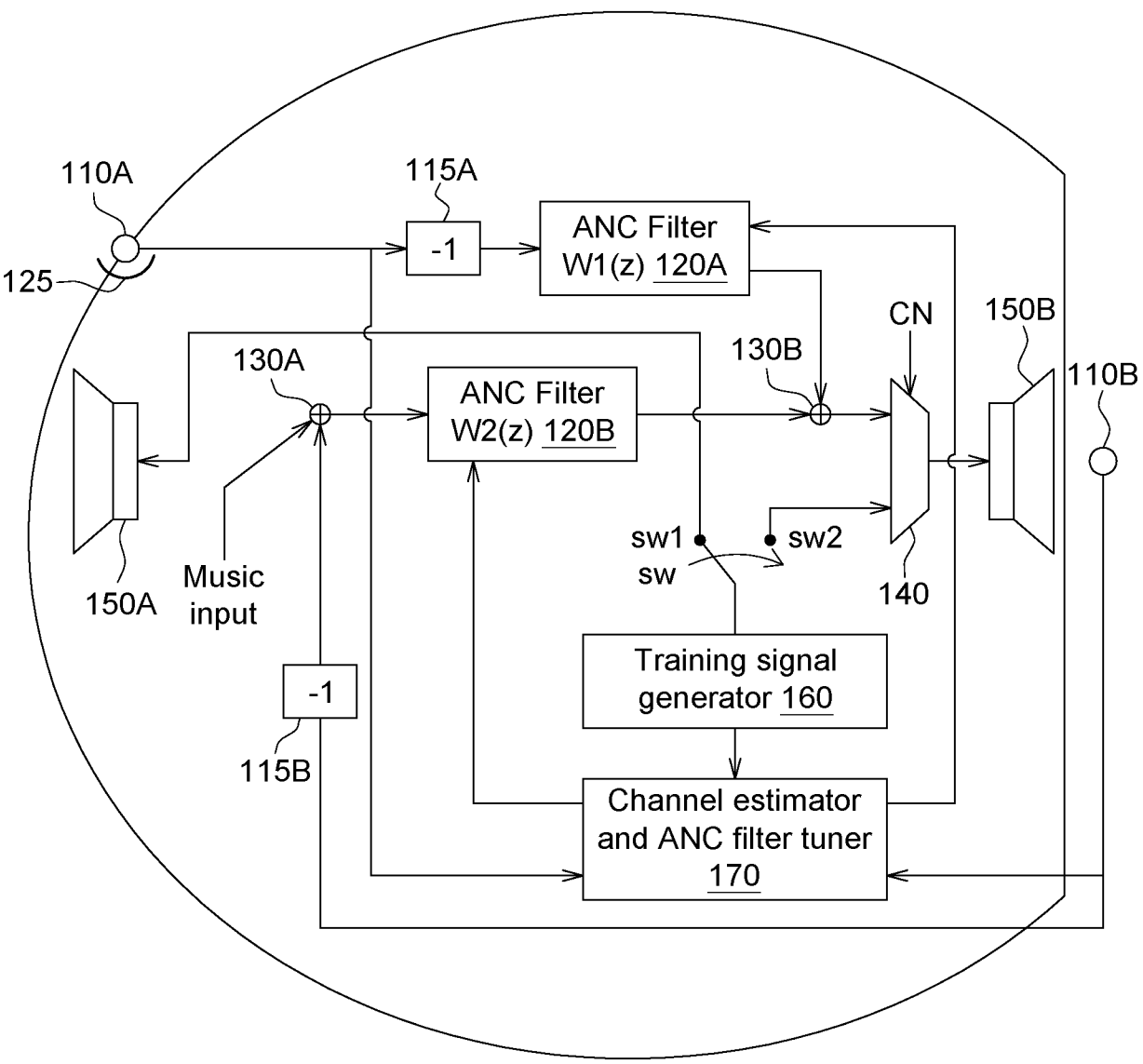
FIG. 1 shows a block diagram for an Active noise cancellation (ANC) headphone according to one exemplary embodiment of the application.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DESCRIPTION OF THE EMBODIMENTS

Technical terms of the disclosure are based on general definition in the technical field of the disclosure. If the disclosure describes or explains one or some terms, definition of the terms is based on the description or explanation of the disclosure. Each of the disclosed embodiments has one or more technical features. In possible implementation, one skilled person in the art would selectively implement part or all technical features of any embodiment of the disclosure or selectively combine part or all technical features of the embodiments of the disclosure.

FIG. 1 shows a block diagram for an Active noise cancellation (ANC) headphone according to one exemplary embodiment of the application. The ANC headphone 100 according to one exemplary embodiment of the application includes: a first microphone 110A, a second microphone 110B, a first inverter 115A, a second inverter 115B, a first ANC filter 120A, a second ANC filter 120B, an isolator 125, a first adder 130A, a second adder 130B, a multiplexer 140, a first speaker 150A, a second speaker 1508, a training signal generator 160, a channel estimator and ANC filter tuner 170 and a switch SW.

The first microphone 110A and the second microphone 110B are used to capture the environment noise.

The first inverter 115A and the second inverter 115B are used to invert the outputs from the first and the second microphones 110A and 110B, respectively.

The first ANC filter 120A and the second ANC filter 120B has transfer functions W1($z$) and W2($z$), respectively.

The isolator 125 is for isolating the first speaker 150A from the first microphone 110A in the channel estimation mode.

The first adder 130A is for adding the music input with the output from the second inverter 115B and for providing the adding result to the second ANC filter W2($z$).

The second adder 1308 is for adding the output from the first ANC filter W1(*z*) with the output from the second ANC filter W2(*z*) and for providing the adding result to the multiplexer 140.

The multiplexer 140 is controlled by a control signal CN. In details, in channel estimation mode, when the switch SW is switched to the node sw2, the multiplexer 140 selects the output of the training signal generator 160. In other situation, the multiplexer selects the output of the second adder 1308.

The first speaker 150A is enabled in channel estimation mode, for transmitting the training signal from the training signal generator 160 to the first microphone 110A or to the second microphone 110B.

The second speaker 1508 is enabled in both the channel estimation mode and the normal mode.

The training signal generator 160 is for generating a training signal in the channel estimation mode. In the normal mode, operation of the training signal generator 160 is ignored.

The channel estimator and ANC filter tuner 170 is for performing channel estimation in the channel estimation mode and for tuning the transfer functions W1(*z*) and W2(*z*) of the first and the second ANC filters in the channel estimation mode.

The switch SW is switched between the nodes sw1 and sw2 in the channel estimation mode. In the normal mode, operation of the switch SW is ignored.

Figure 2:
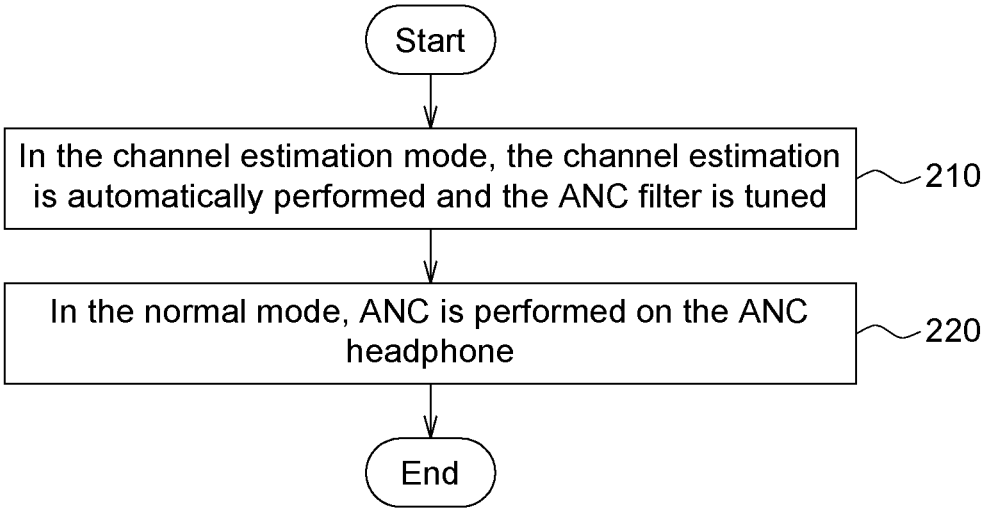
FIG. 2 shows a flow chart for an ANC method according to one exemplary embodiment of the application.

FIG. 2 shows a flow chart for an ANC method according to one exemplary embodiment of the application. In step 210, the ANC headphone enters into the channel estimation mode. In the channel estimation mode, the channel estimation is automatically performed and the ANC filter is tuned. In step 220, the ANC headphone enters into the normal mode. In the normal mode, ANC is performed on the ANC headphone. Details of steps 210 and 220 are described below.

Figure 3A:
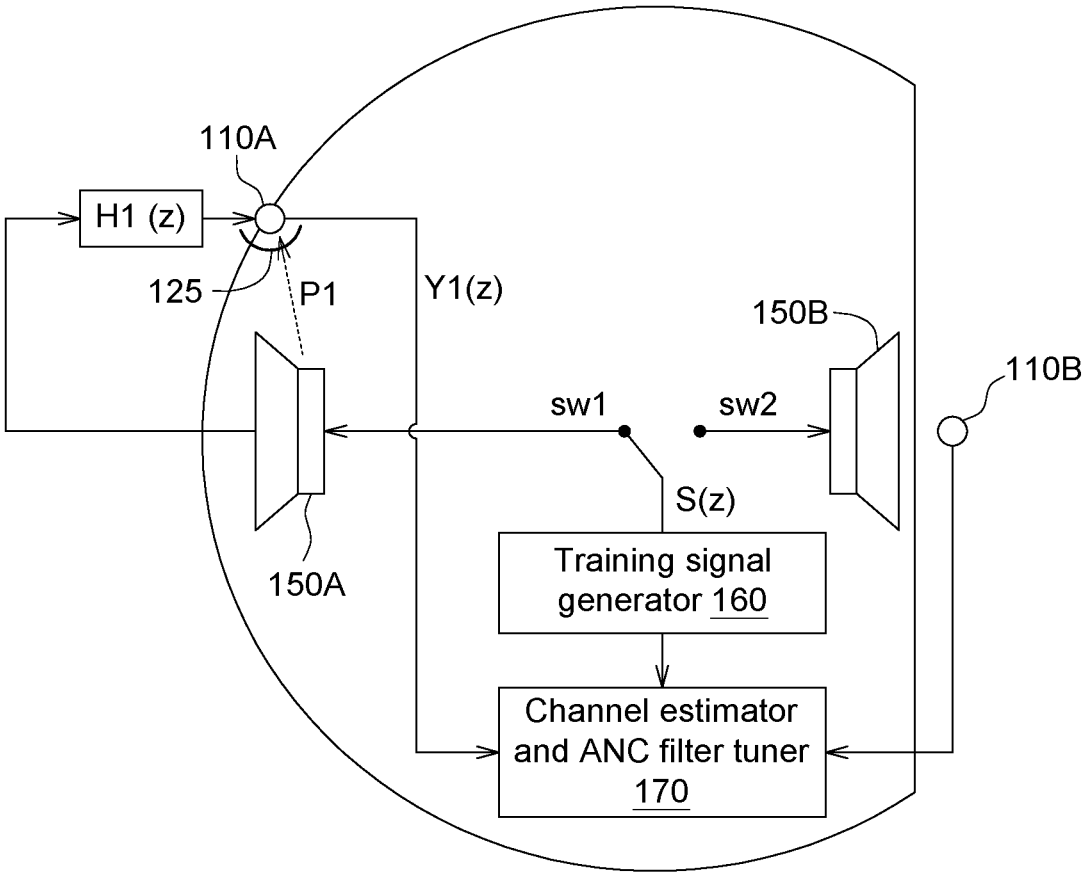
FIG. 3A-FIG. 3C show channel estimation according to one exemplary embodiment of the application.
Figure 3B:
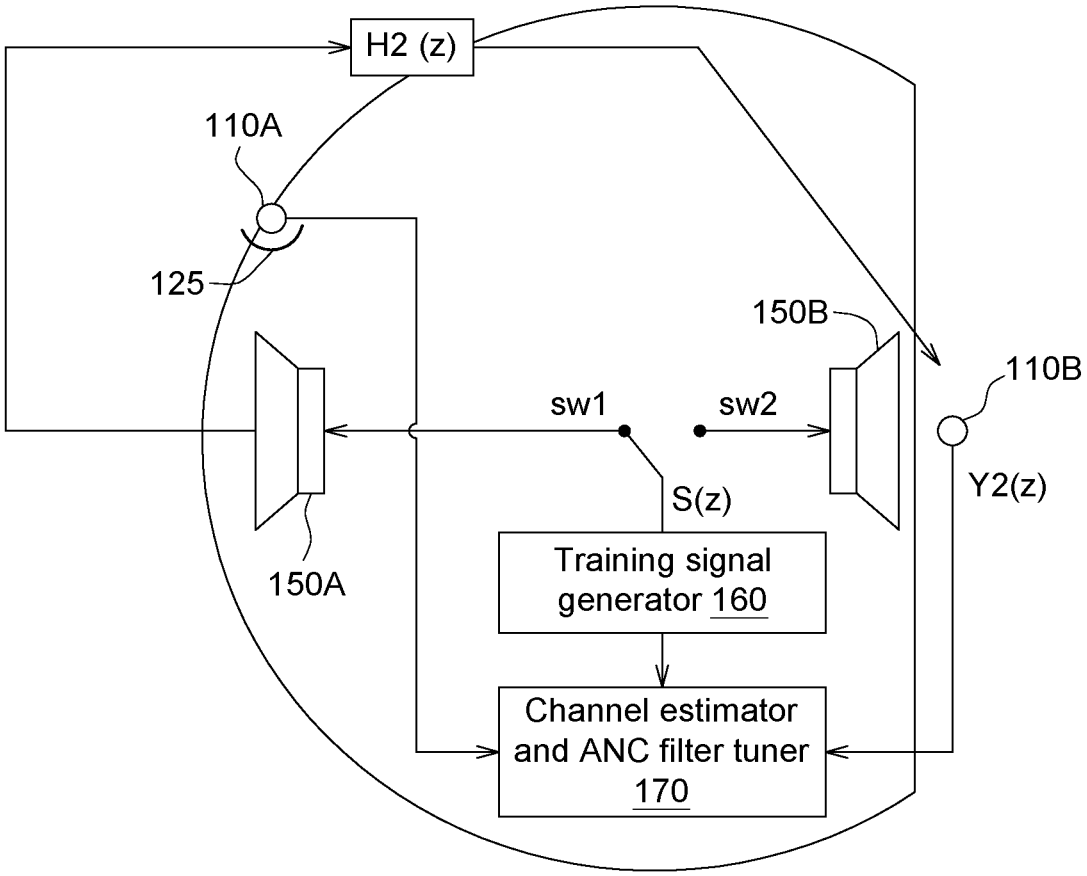
Figure 3C:
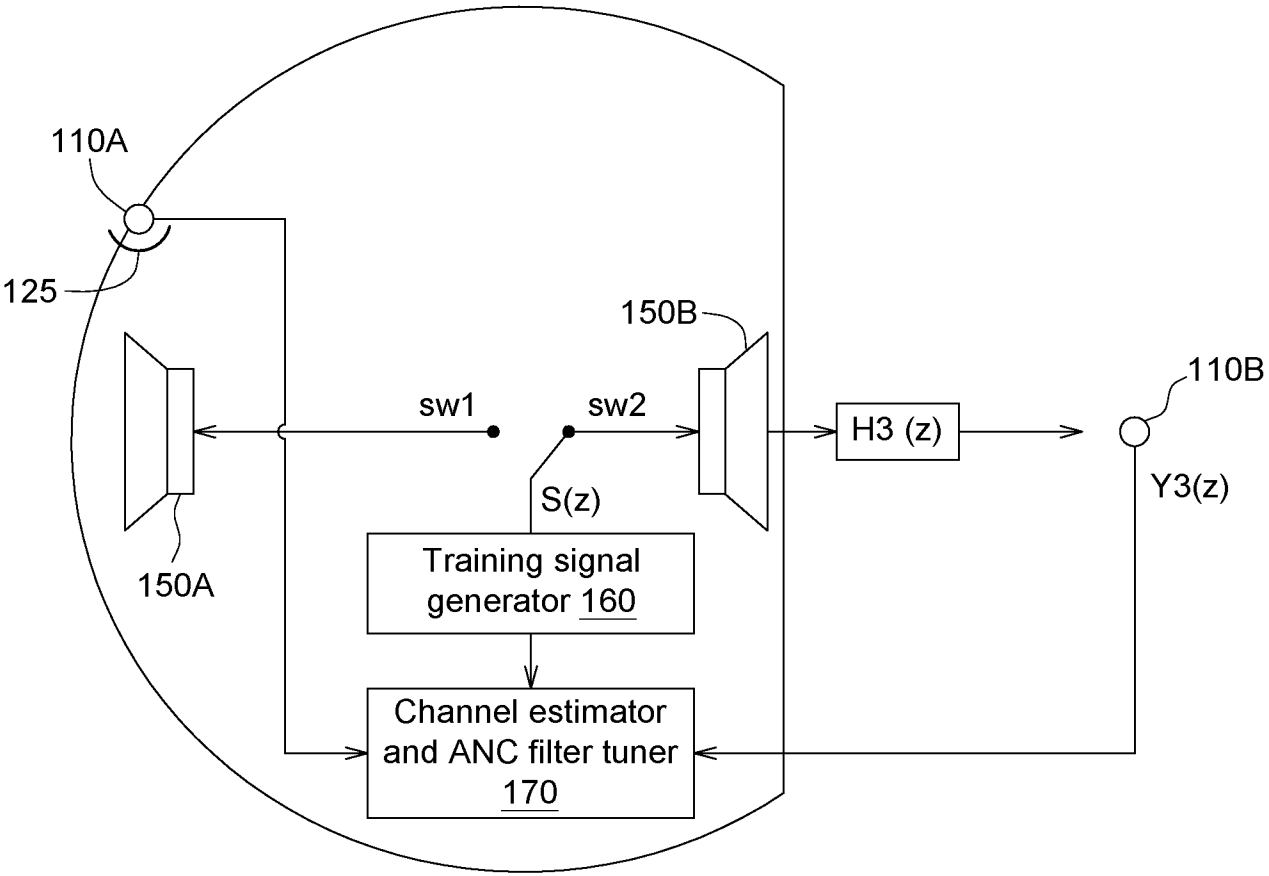

FIG. 3A-FIG. 3C show channel estimation according to one exemplary embodiment of the application. For simplicity, in FIG. 3A-3C, the components which are not necessary for channel estimation are ignored.

In FIG. 3A, for estimating the first environment channel H1(*z*) (the first environment channel H1(*z*) is for example but not limited by, an air channel), the switch SW is switched to the node sw1 (i.e. the training signal generator 160 is coupled to the first speaker 150A via the switch SW) and the training signal generator 160 generates a training signal to the first speaker 150A. The training signal may have any format. In one exemplary, the training signal is for example but not limited by, a random noise.

Then, the training signal is transmitted from the first speaker 150A via the first environment channel H1(*z*) to the first microphone 110A. The isolator 125 is used to isolate the first microphone 110A from the first speaker 150A, in order to prevent the training signal from being directly transmitted from the first speaker 150A via the path P1 to the first microphone 110A. The first microphone 110A captures the training signal. The transfer function Y1(*z*) of the output of the first microphone 110A is expressed as: Y1(*z*)=S(z)*H1(*z*), wherein S(z) represents the training signal. The output of the first microphone 110A is input into the channel estimator and ANC filter tuner 170.

Thus, the channel estimator and ANC filter tuner 170 estimates the first environment channel H1(*z*) as H1(*z*)=Y1(*z*)/S(z). The transfer function Y1(*z*) of the output of the first microphone 110A is obtained by the channel estimator and ANC filter tuner 170 and the training signal S(z) is predetermined. The first environment channel H1(*z*) is estimated by the channel estimator and ANC filter tuner 170.

In FIG. 3B, for estimating the second environment channel H2(*z*) (the second environment channel H2(*z*) is for example but not limited by, an air channel), the switch SW is switched to the node sw1 (i.e. the training signal generator 160 is coupled to the first speaker 150A via the switch SW) and the training signal generator 160 generates the training signal to the first speaker 150A.

Then, the training signal is transmitted from the first speaker 150A via the second environment channel H2(*z*) to the second microphone 110B. The second microphone 110B captures the training signal. The transfer function Y2(*z*) of the output of the second microphone 110B is expressed as: Y2(*z*)=S(z)*H2(*z*). The output of the second microphone 110B is input into the channel estimator and ANC filter tuner 170.

Thus, the channel estimator and ANC filter tuner 170 estimates the second environment channel H2(*z*) as H2(*z*)=Y2(*z*)/S(z). The transfer function Y2(*z*) of the output of the second microphone 110B is obtained by the channel estimator and ANC filter tuner 170 and the training signal S(z) is predetermined. The second environment channel H2(*z*) is estimated by the channel estimator and ANC filter tuner 170.

In FIG. 3C, for estimating the third environment channel H3(*z*) (the third environment channel H3(*z*) is for example but not limited by, an air channel), the switch SW is switched to the node sw2 (i.e. the training signal generator 160 is coupled to the second speaker 150B via the switch SW) and the training signal generator 160 generates the training signal to the second speaker 150B.

Then, the training signal is transmitted from the second speaker 1508 via the third environment channel H3(*z*) to the second microphone 110B. The second microphone 110B captures the training signal. The transfer function Y3(*z*) of the output of the second microphone 110B is expressed as: Y3(*z*)=S(z)*H3(*z*). The output of the second microphone 110B is input into the channel estimator and ANC filter tuner 170.

Thus, the channel estimator and ANC filter tuner 170 estimates the third environment channel H3(*z*) as H3(*z*)=Y3(*z*)/S(z). The transfer function Y3(*z*) of the output of the second microphone 110B is obtained by the channel estimator and ANC filter tuner 170 and the training signal S(z) is predetermined. The third environment channel H3(*z*) is estimated by the channel estimator and ANC filter tuner 170.

Figure 4A:
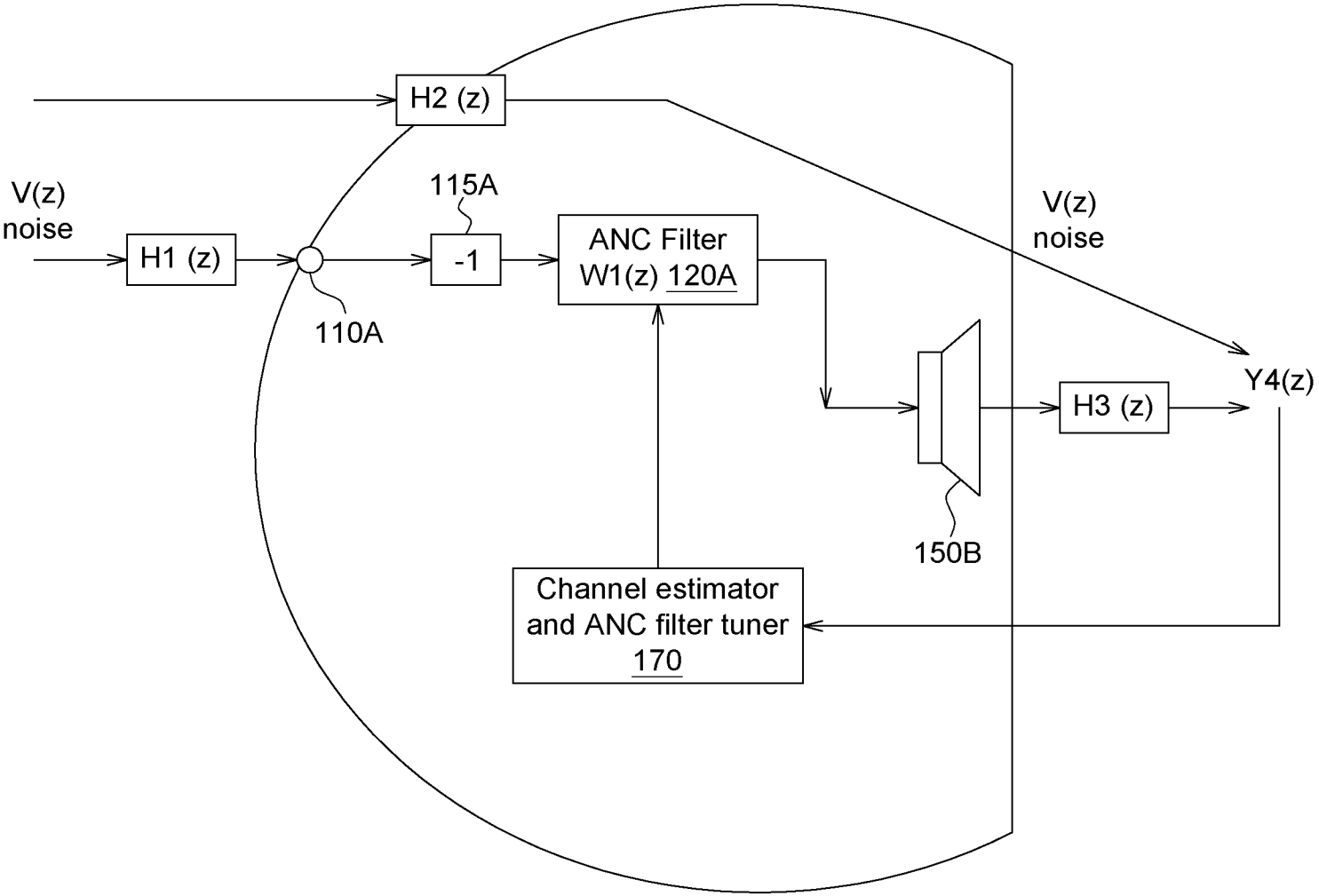
FIG. 4A-FIG. 4B show ANC filter tuning according to one exemplary embodiment of the application.
Figure 4B:
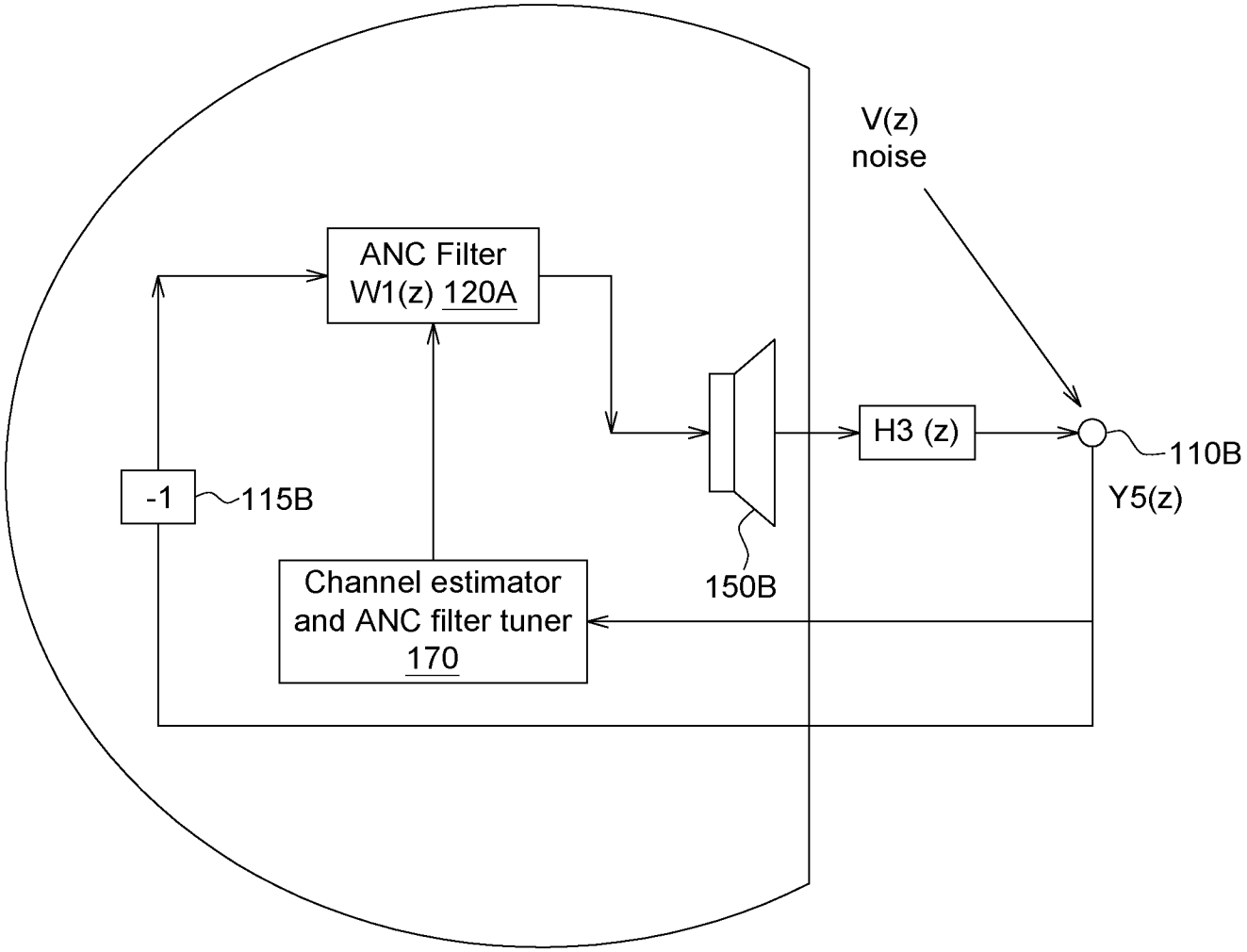

FIG. 4A-FIG. 4B show ANC filter tuning according to one exemplary embodiment of the application. For simplicity, in FIG. 4A-FIG. 4B, the components which are not necessary for the ANC filter tuning are ignored. ANC filter tuning is performed by the channel estimator and ANC filter tuner 170.

As shown in FIG. 4A, the transfer function Y4(*z*) of the noise cancellation signal in the quiet zone is expressed as: Y4(*z*)=V(z)*(H2(*z*)−H1(*z*)*H3(*z*)*W1(*z*)), wherein V(z) refers to the environment noise.

If the transfer function W1(*z*) of the first ANC filter 150A is tuned as: W1(*z*)=H2(*z*)/(H1(*z*)*H3(*z*)) by the channel estimator and ANC filter tuner 170, then Y4(*z*)=0, i.e. the environment noise is cancelled.

Thus, in one exemplary embodiment of the application, the transfer function W1(*z*) of the first ANC filter 120A is tuned as: W1(*z*)=H2(*z*)/(H1(*z*)*H3(*z*)) by the channel estimator and ANC filter tuner 170. The transfer function W1(*z*) of the first ANC filter 120A which is tuned in FIG. 4A is for performing feed-forward ANC; and the transfer function W1($z$) of the first ANC filter 120A is tuned in a feed-forward implementation.

As shown in FIG. 4B, the transfer function Y5($z$) of the output of the second microphone 110B is expressed as: Y5($z$)=V(z)/(1+H3($z$)W2($z$)). In tuning, if H3($z$)*W2($z$) has high gain and negative feedback, then the transfer function Y5($z$) of the output of the second microphone 110B is almost 0. Thus, the environment noise is cancelled.

Thus, in one exemplary embodiment of the application, the transfer function W2($z$) of the second ANC filter 120B is tuned by the channel estimator and ANC filter tuner 170 to keep H3($z$)*W2($z$) having high gain and negative feedback. The transfer function W2($z$) of the second ANC filter 120B which is tuned in FIG. 4B is for performing feedback ANC; and the transfer function W2($z$) of the second ANC filter 120B is tuned in a feedback implementation. If FIG. 4A and FIG. 4B are concurrently performed, then a hybrid ANC is performed.

Figure 5:
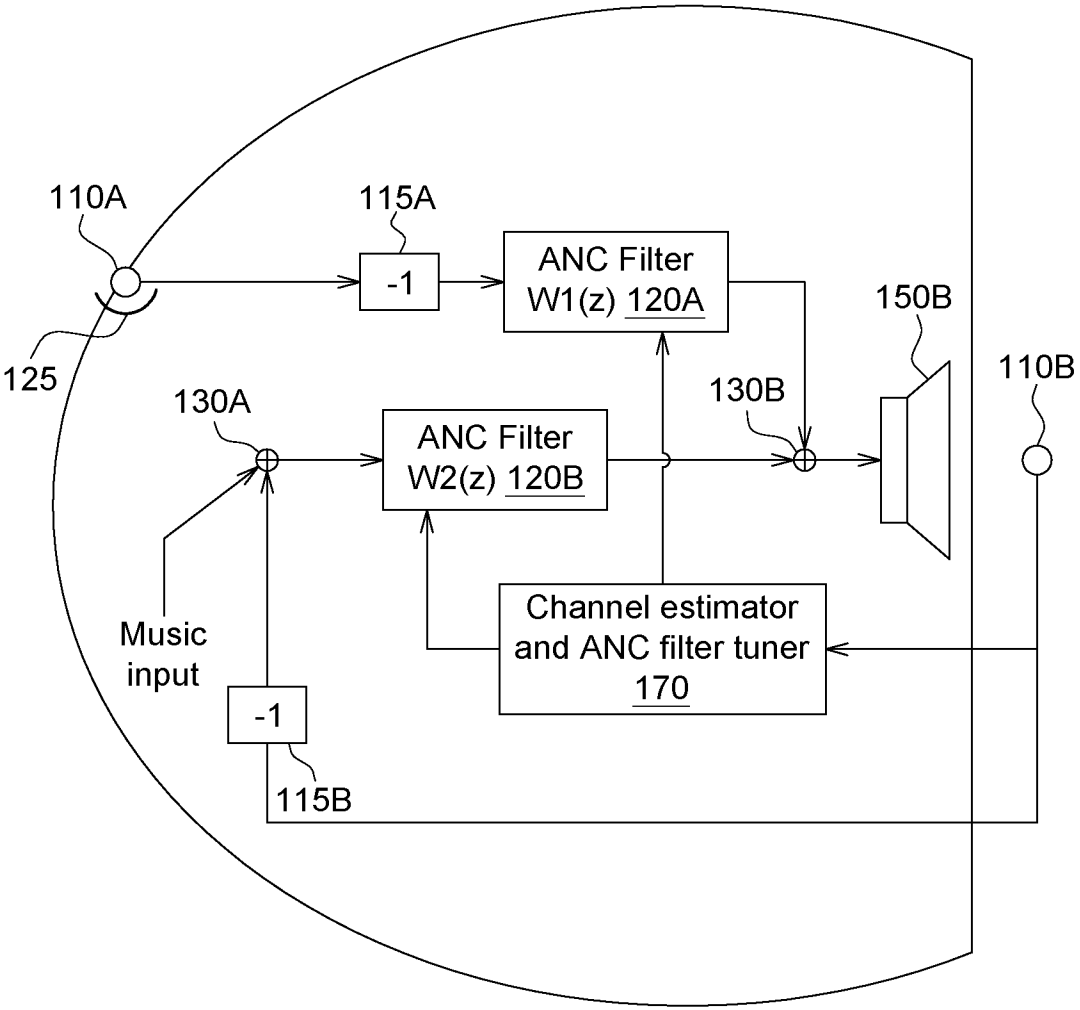
FIG. 5 shows an operation of the ANC headphone in the normal mode according to one exemplary embodiment of the application.

FIG. 5 shows an operation of the ANC headphone in the normal mode according to one exemplary embodiment of the application. For simplicity, in FIG. 5, the components which are not necessary for the normal mode operation are ignored.

In normal mode operation, the music input is input into the first adder 130A. The first adder 130A adds the music input with the output fed back from the microphone 110B via the second inverter 115B. The output of the first adder is input to the second ANC filter 120B. The output of the second ANC filter 120B is input to the second adder 130B. Also, the environment noise is input to the second adder 130B via the first unit gain buffer 115B and the first ANC filter 120A. By the arrangement of FIG. 5, a hybrid ANC is performed.

In other exemplary embodiment of the application, if the second ANC filter 120B is disabled, then a feed-forward ANC is performed. In yet other exemplary embodiment of the application, if the first ANC filter 120A is disabled, then a feedback ANC is performed.

Thus, the active noise cancellation is performed in one exemplary embodiment of the application.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. An active noise cancellation (ANC) headphone including:

a training signal generator for generating a training signal;

a channel estimator and ANC filter tuner;

first and second speaker coupled to the training signal generator;

first and second microphone coupled to the channel estimator and ANC filter tuner;

a plurality of ANC filters coupled to the second speaker; and an isolator, for isolating the first speaker from the first microphone, wherein in a channel estimation mode, the training signal generator generates the training signal to the first and the second speakers, the first and the second microphone captures sounds from the first speaker or from the second speaker, and the channel estimator and ANC filter tuner estimates a plurality of environment channels based on outputs from the first and the second microphones;

in the channel estimation mode, the plurality of ANC filters are tuned by the channel estimator and ANC filter tuner based on the estimated plurality of environment channels; and in a normal mode, ANC is performed on an input signal based on the plurality of ANC filters.

2. The ANC headphone according to claim 1, wherein the training signal generator transmits the training signal to the first speaker;

the first microphone captures the training signal from the first speaker; and the channel estimator and ANC filter tuner estimates a first environment channel of the plurality of environment channels based on the training signal.

3. The ANC headphone according to claim 2, wherein:

the training signal generator transmits the training signal to the first speaker;

the second microphone captures the training signal from the first speaker; and the channel estimator and ANC filter tuner estimates a second environment channel of the plurality of environment channels based on the training signal.

4. The ANC headphone according to claim 3, wherein:

the training signal generator transmits the training signal to the second speaker;

the second microphone captures the training signal from the second speaker; and the channel estimator and ANC filter tuner estimates a third environment channel of the plurality of environment channels based on the training signal.

5. The ANC headphone according to claim 4, wherein:

a first transfer function of a first ANC filter of the plurality of ANC filters is tuned by the channel estimator and ANC filter tuner based on the first, the second and the third environment channels in a feed-forward implementation.

6. The ANC headphone according to claim 5, wherein:

a second transfer function of a second ANC filter of the plurality of ANC filters is tuned by the channel estimator and ANC filter tuner based on the third environment channel in a feedback implementation.

* * * * *